United States Patent [19]

Yamaguchi et al.

[11] 4,189,226

[45] Feb. 19, 1980

[54] ELECTROPHOTOGRAPHIC APPARATUS FOR DEVELOPING AN ELECTROSTATIC LATENT IMAGE ON A SLIDE FILM

[75] Inventors: Isao Yamaguchi, Kyoto; Noboru Katakabe, Katano; Masaru Onishi, Neyagawa, all of Japan

[73] Assignee: Matsushita Electric Industrial Co., Ltd., Osaka, Japan

[21] Appl. No.: 838,402

[22] Filed: Sep. 30, 1977

[30] Foreign Application Priority Data

Sep. 30, 1976 [JP] Japan ..... 51/118113

[51] Int. Cl.[2] ..... G03G 15/10

[52] U.S. Cl. ..... 355/10; 118/661; 118/DIG. 23; 430/103

[58] Field of Search ..... 355/10, 3 SH, 3 R, 5, 355/7, 16; 354/3; 118/661, DIG. 23; 427/15, 17

[56] References Cited

U.S. PATENT DOCUMENTS 3,667,428 6/1972 Smith ..... 118/661

*Primary Examiner*—R. L. Moses

*Attorney, Agent, or Firm*—Wenderoth, Lind & Ponack

[57] ABSTRACT

A photographic apparatus for producing a visible image of an original on a photosensitive film mounted on a slide mount. The apparatus has a supporting structure for supporting a film at a processing position, a film supplying apparatus for supplying a film to the processing position, a processing unit to travel across the film held at the processing position and an optical system for projecting an image of the original onto the processing position. The processing unit includes a charger, exposure window, developing device, drier and a film kicker. The film held at the processing position is charged, exposed, developed and dried during the forward movement of the processing unit and is discharged from the processing position during backward movement of the processing unit by the kicker.

11 Claims, 15 Drawing Figures

ELECTROPHOTOGRAPHIC APPARATUS FOR DEVELOPING AN ELECTROSTATIC LATENT IMAGE ON A SLIDE FILM

This invention relates to a photographic apparatus, and more particularly to an electrophotographic apparatus for producing a visible image of an original on a slide film which has preliminarily been mounted on a slide mount.

There are many different methods and apparatuses for producing a visible image on a slide film. In addition to the apparatus using silver salt photographic films, there is an apparatus using electrophotographic films. The electrophotographic film used in that apparatus comprises an organic photoconductive layer which principally comprises poly-N-vinylcarbazole.

It is necessary in such apparatus that the film be successively brought into alignment with a corona charger, exposing means, developing means and drying means for forming a visual image of an original on said film. Therefore, such apparatus must have a complicated mechanism for transferring the film into alignment with the electrophotographic processing means, and is therefore troublesome to build and operate.

Accordingly, it is an object of this invention to provide a novel apparatus having simple mechanism for easily and quickly producing an image on a slide film.

It is another object of this invention to provide an apparatus for easily producing an image on a slide in focus and without a trimming miss.

It is another object of this invention to provide an apparatus for producing an image on a slide film in a mount without staining the mount.

It is another object of this invention to provide an apparatus for producing an image having reduced background density or fog.

It is another object of this invention to provide an apparatus capable of selectively forming an image of high fidelity to an original (i.e., an image in which the half-tone effect of the original is retained) or a line image (i.e., an image in which the half-tone of the original is converted to either black or white).

It is another object of this invention to provide an apparatus capable of producing an image having reduced edge-effect.

It is yet another object of this invention to produce an apparatus capable of forming a slide having an image of high density and satisfactory clarity.

These objects are achieved by the apparatus according to the present invention, which includes supporting means for supporting a film which is mounted on a mount at a processing position, film supplying means for supplying the film to the processing position, a processing unit which can travel across the film including a charger, an exposure window, developing means, a drier and a film kicker, and optical means for projecting an image of an original on the processing position, wherein said film is charged, exposed developed and dried during the movement of said processing unit from a first position to a second position and is discharged from the processing position by said film kicker during the backward movement of said processing unit from the second position to the first position.

These and other objects and features of this invention will become apparent from the following detailed description taken in conjunction with the accompanying drawings, in which.

Referring to the drawings, a preferred embodiment of the apparatus constructed in accordance with this invention is illustrated. In the drawings, like elements will be designated by like reference numerals.

Figure 1:
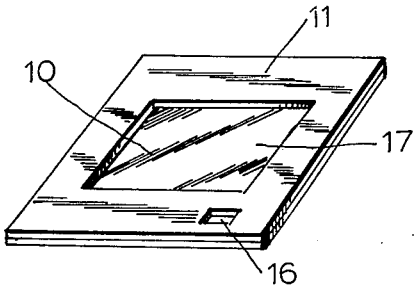
FIG. 1 is a perspective view of the photosensitive film mounted in a mount and used in the apparatus according to this invention.

As shown in FIG. 1, the photosensitive film 10 used in the apparatus according to this invention is preliminarily mounted in a slide mount 11. The size of said slide mount 11 is 50 mm×50 mm and the thickness is 1.6 mm. The slide mount 11 has an aperture 17 having a size of 34 mm×23 mm.

Figure 2:
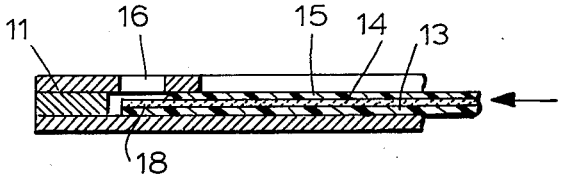
FIG. 2 is an enlarged partial sectional view of the film and mount.

As shown in FIG. 2, photosensitive film 10 mounted in the mount 11 is composed of a transparent film base 13, a conductive layer 14 and a photosensitive layer 15. The film base 14 is made of polyethylene terephthalate or the like. The conductive layer 14 is formed by a transparent thin film of copper iodide or the like evaporatively deposited on the film base 13. The photosensitive layer 15 which is overlaid on the conductive layer 14 is a transparent electrophotosensitive material such as an organic photoconductive material which principally comprises poly-N-vinylcarbazole. The conductive layer 14 is exposed at one portion 18 thereof to a grounding window 16 in the mount 11. The conductive layer 14 can be electrically grounded by contacting a grounding lead to the exposed portion 18 through the grounding window 16.

Figure 3:
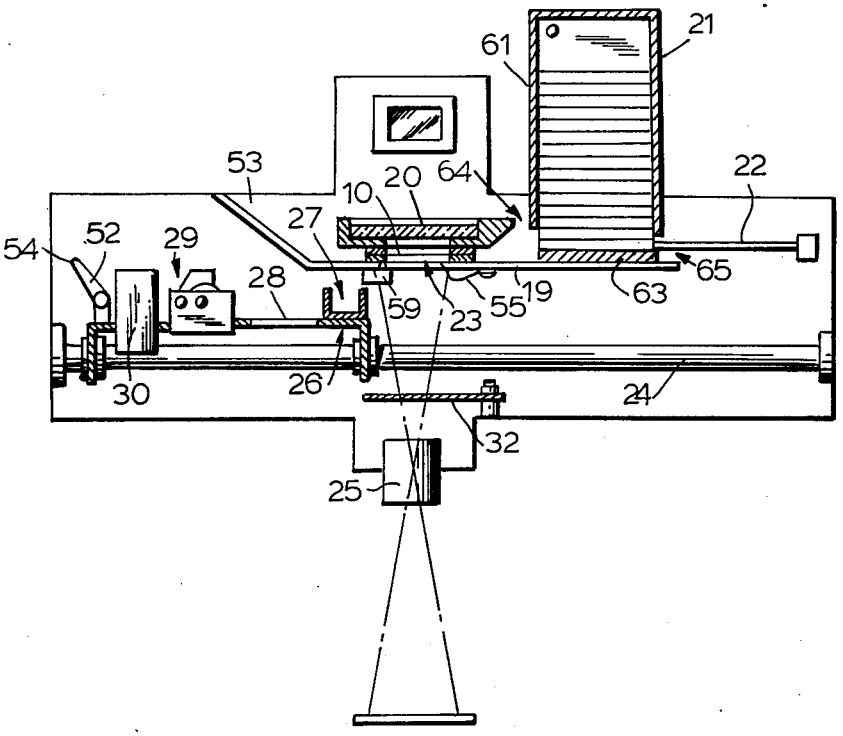
FIG. 3 is a front view, partially in cross-section, of the apparatus according to this invention.

Hereinafter, the photosensitive film with the slide mount in which the film is mounted will simply be called film 10. Referring to FIG. 3, a required number of films 10 are set in place in a film magazine 21 from which each film is fed into a processing position 23. A film 10 is fed from the magazine 21 and is held stationary in the processing position 23 between a film guide plate 19 and a focusing plate 20.

A processing unit 26 moves in a direction parallel to the surface of the film 10 which is held in the processing position 23 to sequentially bring a charger 27, an exposure window 28, developing means 29 and a drier 30 into alignment with the surface of said film 10. The processing unit 26 is slidably mounted on a pair of guide rods 24. The speed of the movement of the processing unit 26 is 12 mm/sec in this embodiment.

The charger 27 comprises a shield having an opening therein opposed to the film 10 and a corona discharge electrode in the shield and which has a discharge voltage applied thereto from a high positive voltage source. When the charger 27 moves across the surface of the film 10 held in the processing position 23, the discharge from the corona discharge electrode causes the photosensitive layer 15 of the film 10 to be charged.

The exposure window 28 is formed in the processing unit 26 adjacent to the charger 27. When the exposure window 28 comes into alignment with the optical axis of a lens unit 25, an image of an original is projected onto the surface of the photoconductive layer 15 of the film 10 through the exposure window 28, and a latent electrostatic image is formed on the surface of the photoconductive layer 15 of the film 10.

The developing means 29 is provided adjacent to the exposure window 28 on the processing unit 26. When the developing means 29 moves across the surface of the film 10, a liquid developer is uniformly applied to the surface of the film 10 to make the electrostatic latent image formed thereon visible. The liquid developer used in the apparatus has finely divided electroscopic negative charged powder dispersed in a solvent such as a petroleum-solvent.

Figure 4:
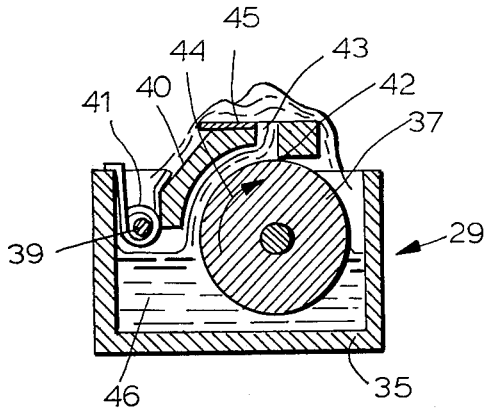
FIG. 4 is a sectional and view of developing means used in the apparatus of this invention.
Figure 5:
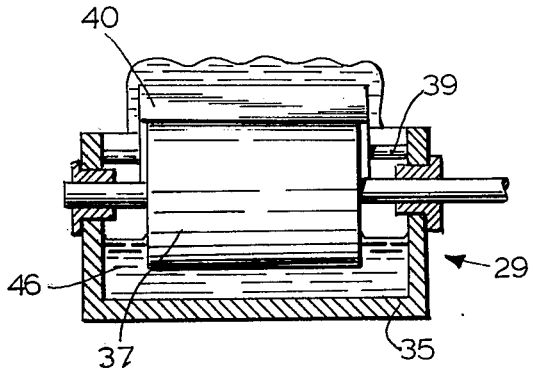
FIG. 5 is a front view, partially in cross-section, of said developing means.

Referring to FIG. 4 and FIG. 5, the details of the developing means 29 will be described. A developing vessel 35 is fixed to the processing unit 26. A liquid developer 46 is contained in the vessel 35 and the level of the liquid developer 46 in the vessel 35 is kept at a predetermined level. A developing roller 37 which is rotated in the direction indicated by an arrow 44 by suitable driving means (not shown) has its outer peripheral surface partially immersed in the liquid developer 46 contained in the vessel 35. The roller 37 is made of a fluorocarbon resin. Overflow means 40 is pivotally mounted on a pivot 39. The edge 42 of the overflow means 40 is urged toward the peripheral surface of the developing roller 37 at the top point of the roller 37 by the resilience of a spring 41.

Figure 6:
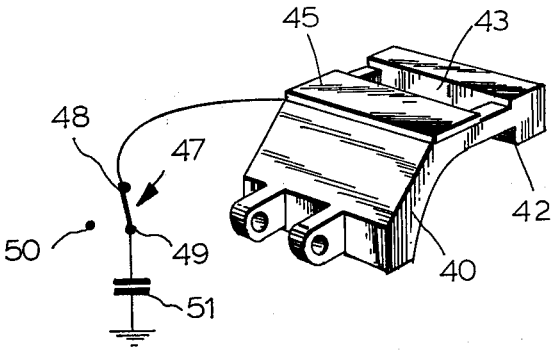
FIG. 6 is a perspective view of overflow means used in said developing means.

The shape of the overflow means 40 is shown in FIG. 6. The overflow means 40 has a slit 43 in the upper portion thereof. The size of the slit 43 is 23 mm×2 mm. The length of the slit 43 corresponds exactly to the short side of the aperture 17 in the slide mount 11. The liquid developer 46 is conveyed upwardly in a layer on the peripheral surface of the roller 37 from the predetermined level of the liquid developer upon the rotation of the roller 37. The layer of the liquid developer being conveyed on the peripheral surface is intercepted by the edge 42 of the overflow means 40, and thus the liquid developer overflows through the slit 43 and thus can be brought into contact with the downwardly facing surface of the film 10. The liquid developer overflowing from the slit 43 is in contact with the surface of the film 10 and is not in contact with the surface of the slide mount 11. The mount 11 is not stained by the liquid developer. Overflow means 40 is made of polyacetal resin.

Upon the rotation of the roller 37, the peripheral surface of the roller 37 is rubbed by the edge 42 of the overflow means 40, and there occurs friction between the edge 42 and the roller 37. Due to this friction, the peripheral surface of the roller 37 is charged with a charge of one polarity and the edge 42 of the overflow means 40 is charged with the opposite polarity. According to the apparatus of this invention, it is preferable that the toner be negatively charged. Therefore, the materials of the roller and the overflow means are so selected that the surface of the roller becomes negatively charged and the edge of the overflow means becomes positively charged due to the friction therebetween. Thus, the toner which is negatively charged is repelled from the peripheral surface of the roller 37 which is charged with the same polarity as that of the toner. The edge 42 of the overflow means 40 is positively charged and attracts the toner. The toner adhered to the surface of the overflow means 40 remains thereon.

If the peripheral surface of the roller 37 were positively charged and the edge 42 of the overflow means 40 were negatively charged where the toner is negatively charged, the toner would be attracted onto the surface of the roller 37. Generally, the toner is finely divided in the liquid developer. But the toner adhered on the surface of the roller 37 would be in the form of gathered grains or particles. As the roller 37 rotated further, the toner adhered on the surface of the roller 37 would be scraped off by the edge 42 of the overflow means 40. The grains or toner particles scraped off the surface of the roller 37 would overflow from the slit 43 with the flow of the liquid developer. The liquid developer which overflowed from the slit 43 would be applied to the surface of the film 10, and the grained toner particles scraped off the peripheral surface of the roller 37 would be deposited on the surface of the film 10 unrelated with the latent image of the film 10. The deposited toner particles unrelated with the latent image form "fog". Because this fog is formed with gathered grain particles, the background density of fog would be high, and the projected image from the slide would be dark.

The apparatus according to this invention produces a slide without fog, because the roller 37 is charged with the same polarity as that of the toner, as the roller 37 rotates and as the peripheral surface of the roller 37 frictionally contacts the edge 42 of the overflow means 40.

In the case when liquid developer has a negative polarity, it is desired, for reducing the fog, that the roller 37 be made of a fluorocarbon resin and the overflow means 40 be made of a polyacetal resin. By actually rubbing against each other, in the liquid developer having negatively charged toner, two plastic materials taken from polyacetal resin, polymethyl methacrylate, phenolic resin, polyethylene and fluorocarbon resin, it has been found that polyacetal resin has the highest chargeability with a positive charge, and the chargeabilities of the plastic materials with a positive charge become lower in the order in which the materials are recited. That is, for example, when polymethyl methacrylate and phenolic resin are rubbed against each other, polymethyl methacrylate becomes positively charged, and phenolic resin becomes negatively charged.

The edge 42 of the overflow means 40 contacting the peripheral surface of the roller 37 is preferably round. The round edge of the overflow means 40 does not damage the peripheral surface of the roller 37 and does not scrape off the toner deposited on the peripheral surface of the roller 37.

A developing electrode plate 45 is attached to the surface of the overflow means 40, and faces the surface of the film 10. The electrode plate 45 is a thin metal plate. The size of the electrode plate 45 is 0.1 in mm thickness, 5 mm in width and 23 mm length. The electrode plate 45 passes in the vicinity of the surface of the film 10. The liquid developer overflowing from the slit 43 flows between the electrode plate 45 and the surface of the film 10 and drops into the vessel 35. The electrode plate 45 prevents the generation of edge effect as the result of an electrode realignment effect of the electrostatic field surrounding the electrostatic latent image on the film 10 during development.

The electrode plate 45 is electrically connected with a switch 47, and upon contact of a contact 48 of the switch 47 with a contact 49 coupled to the ground, the electrode plate 45 is electrically connected to the body of the apparatus that is at a grounding potential through a capacitor 51. Upon contact of the contact piece 47 with a contact 50 which is isolated from the ground, the electrode plate 45 is electrically insulated from the body of the apparatus. The capacitance of the capacitor 51 is 0.1 $\mu$F, and the resistivity of the capacitor is selected so as to be higher than $10^{10}\Omega$.

The drier 30 comprises a heater, a fan and a ventilation duct. The drying step takes place by blowing hot air against the developed surface of the film 10 from a ventilation duct of the drier 30 when the drier 30 comes below the film 10 held in the processing position 23. The liquid developer on the surface of the film 10 is evaporated.

Figure 14:
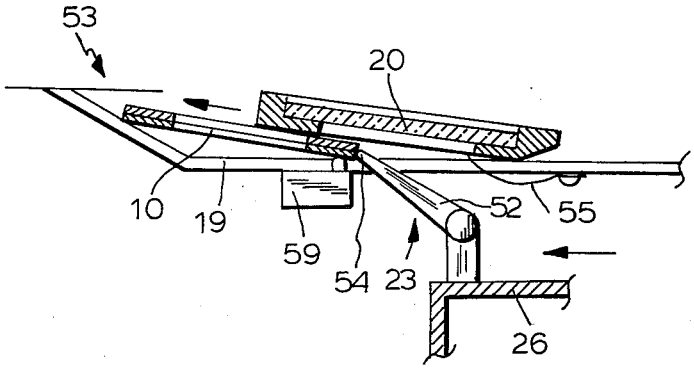
FIG. 14 is an enlarged sectional view showing the manner of discharging the film from the processing position.

A film kicker 52 is positioned adjacent to the drier 30 on the processing unit 26. An end portion 54 of the film kicker 52 is urged upward by the resilience of a spring (not shown). The end portion 54 of the film kicker 52 is depressed by the mount surface of film 10 and passes under the film 10 held in the processing position 23, as the processing unit 26 moves to the right in FIG. 3. Upon the backward movement of the processing unit 26 to the left as shown in FIG. 14, the end portion 54 of the film kicker 52 pushes the film 10 out of the processing position 23 to an outlet 53 of the apparatus.

Upon energization of a solenoid (not shown), a shutter blade 32 is moved into the path of the light coming through the lens unit 25 (in FIG. 3). The energization of the shutter solenoid is controlled by the switch 59 which is provided in the path of the film along the film guide plate 19. When the film 10 is supplied to the processing position 23, the mount 11 of the film 10 closes the switch 59 and the shutter solenoid is energized, and then the shutter blade 32 blocks the path of the light through the lens unit 25.

Figure 7:
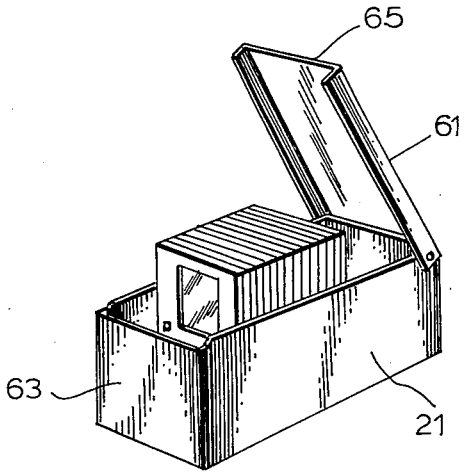
FIG. 7 is a perspective view of a film magazine.
Figure 8:
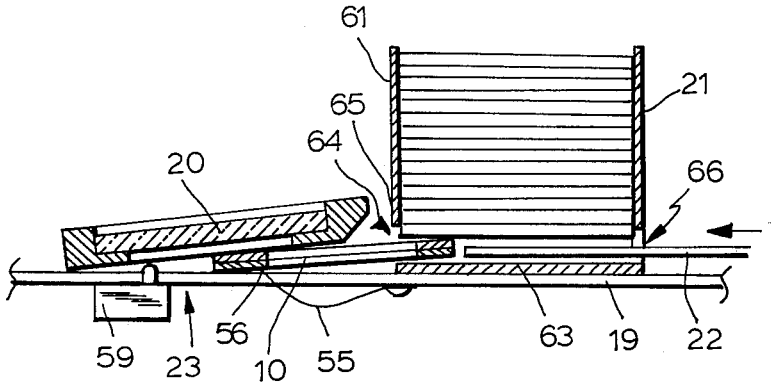
FIG. 8 is an enlarged sectional view showing the manner of supplying said film in a mount to the processing position.

The film supplying means comprises the film magazine 21 and a feeder lever 22. The films are loaded into the film magazine 21 by opening a cover 61 of the magazine 21. The shape of the magazine 21 is shown in FIG. 7. After the cover 61 is closed, a gap 64 which allows only one film to pass therethrough is defined between the bottom 63 of the film magazine 21 and the end portion 65 of the cover 62 as shown in FIG. 8. An inlet 66 for the feeder lever 22 is provided at the opposite side of the magazine 21 from the gap 64. A film 10 is transferred from the magazine 21 to the processing position 23 by drawing the feeder lever 22 to the left as shown in FIG. 8.

The focusing plate 20 is provided in alignment with the optical axis of the lens unit 25 and is pressed against the film guide plates 19. The light image of the original is focused on the focusing plate 20. The film 10 having been fed from the magazine 21 is transferred into the gap between the film guide plate 19 and the focusing plate 20 shown in FIG. 8 by pushing the focusing plate 20 upwardly. When the film 10 is transferred to the processing position 23 shown in FIG. 9, the light image of the original can be focused on the surface of the film 10 during the exposure time. The size and alignment of the focusing plate 20 corresponds to that of the aperture 17 in the slide mount 11.

Figure 11:
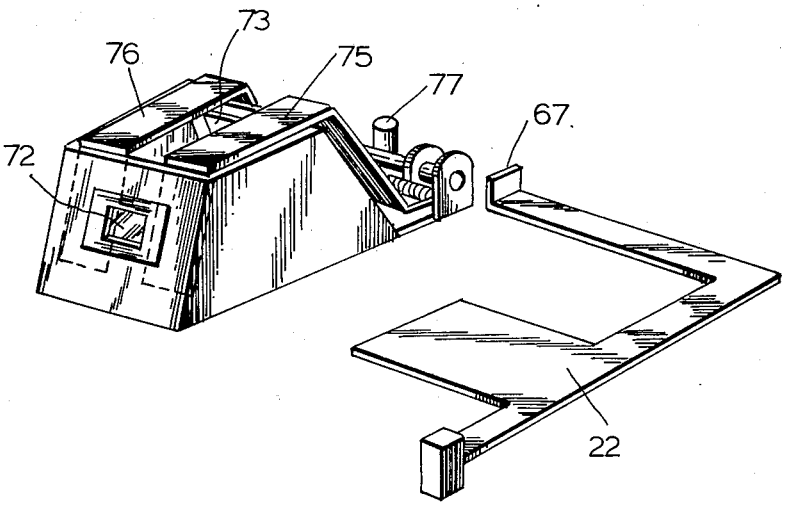
FIG. 11 is a perspective view of a finder and a finder cover used in the apparatus of this invention.

Before the film is supplied to the processing position 23, the image of the original focused on the focusing plate 20 can be observed through the finder 72 and mirror 73, as shown in FIG. 11 for focusing and trimming the original. Referring to FIG. 11, a first finder cover 75 and a second finder cover 76 are provided to block the light from the finder 72 from reaching the film 10 which is held in the processing position during the processing operation.

Figure 9:
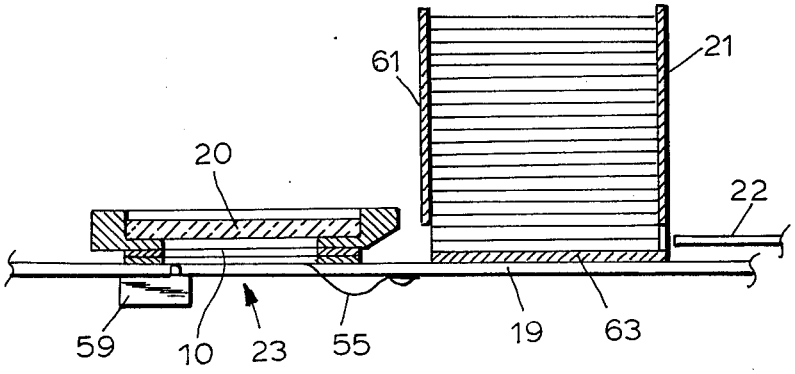
FIG. 9 is an enlarged sectional view showing the manner of holding said film at said processing position.
Figure 10:
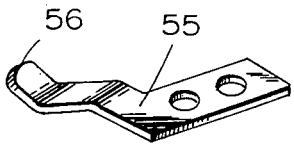
FIG. 10 is a perspective view of a grounding resilient plate used in the apparatus of this invention.

Referring to FIG. 3, FIG. 8 and FIG. 9, a grounding resilient plate 55 contacts the exposed conductive layer of the film 10 through the grounding window 16 of the film mount when the film is in the processing position 23. The shape of the grounding resilient plate 55 is shown in FIG. 10. The contact pressure of the grounding resilient plate 55 with the exposed conductive layer of the film 10 is determined by the resilient force thereof. The ground resilient plate 55 is made of a flexible thin metal plate and is fixed to the film guide plate 19. Therefore, the conductive layer of the film 10 held in the processing position 23 is electrically grounded through the grounding resilient plate 55 and the film guide plate 19.

While the film 10 is being transferred from the magazine 21 to the processing position 23, the end portion 56 of the grounding resilient plate 55 is pushed down by the surface of the mount for the film 10. The end portion 56 slides thereon and then enters the grounding window 16. Referring to FIG. 14, when the film 10 is pushed to the left by the kicker 52 after processing, the end portion 56 of the grounding resilient plate 55 is again bent downwards by the surface of the film mount 11, and thus the film is smoothly discharged from the outlet 53.

The grounding window 16 in the mount for the film 10 is positioned outwardly of the longer side of the aperture 17. Because the film 10 is transferred in a direction parallel to the longer side of the aperture 17, the end portion 56 of the grounding resilient plate 55 slides on the surface of the film mount 11, and thus the end portion 56 does not touch the surface of photoconductive layer 15 of the film 10 while the film 10 is being transferred.

The following description will outline the fundamental operation for producing an image of an original on a slide film preliminarily mounted in a mount.

When a film 10 is not held in the processing position 23, the shutter blade 32 is out of the light path through the lens unit 25, and the image of the original to be copied is projected upon the focusing plate 20. Therefore, the image projected upon the focusing plate 20 can be observed through the finder 72 and the mirror 73 for focusing and trimming of the original. After focusing and trimming the original, the operator pushes the feeder lever 22 to the left (FIG. 3). One of the films 10 loaded in the film magazine 21 is transferred into the processing position 23.

Figure 12:
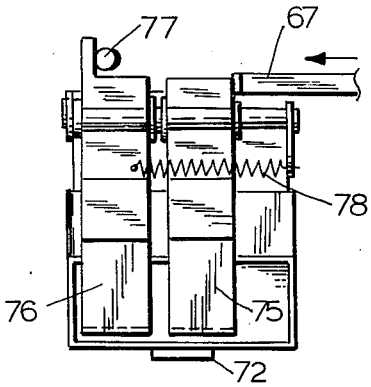
FIG. 12 and FIG. 13 are plan views showing the relationship between the finder and the finder cover shown in FIG. 11.

While the film 10 is transferred, the end portion 67 of the feeder lever 22 pushes the first finder cover 75 to the left (in FIG. 12). The light coming through the finder 72 is thus blocked by the first finder cover 75. The surface of the film mount 11 pushes the actuator of the switch 59. Upon energization of the shutter solenoid, the shutter blade 32 is moved to the blocking position to block the light path through the lens unit 25. Thus, the light coming through the lens unit 25 and the finder 72 are not projected onto the processing position 23.

Figure 13:
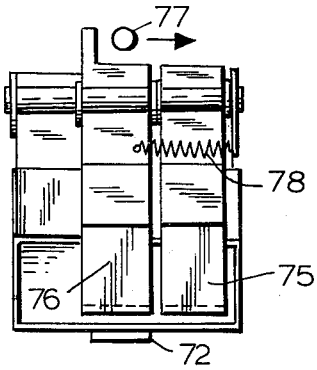

The film 10 which has been transferred from the magazine 21 is forced in between the focusing plate 20 and the film guide plate 19 as shown in FIG. 8, and stops at the position of the focusing plate 20 as shown in FIG. 9. After the film 10 is thus transferred to the processing position 23, the processing unit 26 starts to move to the right (in FIG. 3), that is, in the forward direction from the first position. Upon the movement of the processing unit 26, the second finder cover 76 which has been thrust to the left (in FIG. 12) by the pin 77 provided on the processing unit 26 moves to the position which the first finder cover 75 has occupied, due to the resilience of a spring 78 as shown in FIG. 13. The light coming through the finder 72 is thus blocked by the second finder cover 76. The first finder cover 75 is forced to the previous position by the second finder cover 76.

During the movement of the processing unit 26 to the right (in FIG. 3), the corona discharge electrode of the charger 27 is supplied with a high positive potential. The corona discharge electrode discharges a uniform corona charge onto the surface of the photosensitive layer 15 of the film 10 which is held in the processing position 23. The surface of the photosensitive layer 15 is charged up to about 800 volts. When the processing unit 26 has moved below the film 10 held in the processing position 23, the energization of the charger 27 is stopped and the charging step of the film 10 comes to an end.

When processing unit 26 moves to where the exposure window 28 is in alignment with the optical axis of the lens unit 25, the processing unit 26 is immediately stopped. Then the exposure step takes place. When the processing unit 26 stops, the shutter blade 32 is immediately moved out of the light path through the lens unit 25 whereby the image of the original is projected upon the photosensitive surface of the film 10. This continues for a time period determined by a timer, and thereafter the shutter blade 32 is restored to the blocking position to block the light path through the lens unit 25. Thereupon, the processing unit 26 resumes its movement to the right.

The developing step takes place during the movement of the developing means 29 across the film 10 held in the processing position 23. When the slit 43 of the overflow means 40 is in alignment with the left end portion of the aperture 17 of the slide mount 11, the roller 37 immediately starts rotating. Upon the rotation of the roller 37, the liquid developer 46 is conveyed by the peripheral surface of the roller 37 and is intercepted by the edge 42 of the overflow means 40. The liquid developer overflows through the slit 43 and is brought into contact with the surface of the film 10 without staining the mount 11. Upon the movement of the processing unit 26, the latent electrostatic image formed on the film 10 by the light exposure is developed to a visible image by the developer liquid.

When the slit 43 arrives at the right end portion of the aperture 17 of the slide mount 11, the roller 37 immediately stops its rotation. The overflow of the liquid developer from the slit 43 stops. Because the roller 37 rotates only while the slit 43 passes under the aperture 17 of the slide mount 11 and the liquid developer is supplied to the surface of the film 10 only during this time, the contact of the liquid developer with the surface of the film 10 is limited to the aperture area of the slide mount, and the remainder of the slide mount 11 is prevented from being stained by the liquid developer.

After the developing step, the ventilation duct of the drier 30 is located opposite to the film 10 held in the processing position 23. The processing unit 26 stops there. The hot air from the ventilation duct of the drier 30 blows against the surface of the film 10. This continues for a predetermined time. The liquid developer remaining on the surface of the film 10 is then evaporated.

Then, the processing unit 26 again starts moving to the right (in FIG. 3). The end portion 54 of the film kicker 52 passes under the film 10. When the processing unit 26 arrives at the second position at which its travel in the forward direction ends, the processing unit 26 begins to move to the left (in FIG. 3), i.e., the backward direction. The film kicker 52 kicks the film 10 out of the processing position 23 as shown in FIG. 14. The film 10 is discharged from the outlet 53. The switch 59 is opened and the shutter solenoid is deenergized so that the shutter blade 32 is moved out of the light path through the lens unit 25. The image of an original is again projected upon the focusing plate 20.

Upon the backward movement of the processing unit 26, the second finder cover 76 is pushed to the left as shown in FIG. 11 by the pin 77 provided on the processing unit 26. Therefore, the image projected on the focusing plate 20 can again be observed through the finder 72. The processing unit 26 arrives at its first position, at the end of the backward movement, and stops there.

In the apparatus of this embodiment, the contact 49 of the switch 47 is connected to a 0.1 $\mu$F capacitor, and the contact 50 of the switch 47 is open. If the original comprises a line drawing, the contact 48 of the switch 47 is connected to the contact piece 50. If the original is of a continuously toned nature or contains large dark areas, the contact 48 of the switch 47 is connected to the contact 49.

Figure 15:
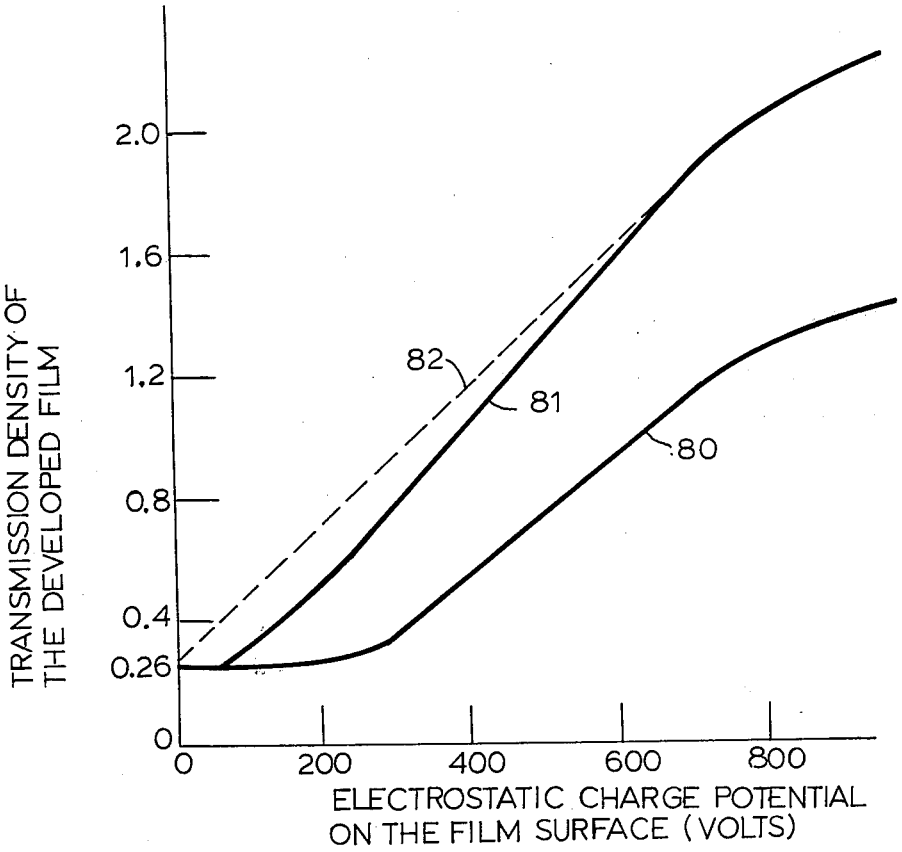
FIG. 15 is a graph showing the relation between the electrostatic charge potential on the film surface and the transmission density of the film which has been developed by the developing means.

FIG. 15 is a graph illustrating the results of developing by the apparatus of this invention under different conditions, that is a graph of the voltage of the electrostatic charge potential on the surface of the film versus transmission density of the developed film. The transmission density is the common logarithum of the reciprocal number of the transparency ratio of the film. Curve 80 is obtained under the developing condition that the contact 48 of the switch 47 is connected to the contact 50, that is, the developing electrode plate 45 is electrically insulated from the conductive layer 14 of the film 10 and the body of the apparatus.

Curve 81 is obtained under the developing condition that the contact 48 of the switch 47 is connected to the contact 49, that is, the developing electrode plate 45 is connected through the 0.1 $\mu$F capacitor 51 to the conductive layer 14 of the film 10. The base transmission density of the film is 0.26. The curve 80 shows that the transmission density is 0.26 in a range from 0 to about 200 volts. The toner is hardly adhered to the surface of the film in this range. Even when the background of the original has a non-uniform density, i.e., even when the potential of one portion of the background area on the film is different from that of another portion of the background area on the film, and the potentials range from 50 volts to 100 volts or 150 volts, the toner in a developer liquid can be prevented from adhering to the background area on the film because the potentials are all below 200 volts.

Above 200 volts, the toner adheres to the surface of the film more and more as the voltage of the surface potential increases. Hardly any toner is adhered to the background area on the film and this produces a line image having reduced fog and satisfactory clarity. The edge-effect of the images containing large dark areas above 200 volts is substantially reduced by the effect of realignment of the electrostatic field of the insulated electrode plate 45.

Curve 81 is obtained under the condition that the developing electrode plate 45 is electrically connected through the 0.1 μF capacitor 51 to the conductive layer 14 of the film 10. The toner does not adhere on the surface of the film 10 having a potential ranging from 0 to about 50 volts. Above 50 volts, the toner adheres to the surface of the film 10 in proportion to the voltage of the surface potential of the film more and more as the voltage increases, and this produces continuous toned images, which achieves reproduction of the continuous changing tones of the images and high density.

Curve 82 is obtained under the condition that the electrode plate 45 is directly connected to the conductive layer 14 of the film 10 without a capacitor. In this case, the toner adheres to the surface of the film in proportion to the voltage of the surface potential above 0 volts. In general, a very long exposure time is required to reduce the voltage of the surface potential to 0. In the case of a long exposure time, a latent image of a high density is reduced to an image of low potential, and an excellent high contrast image cannot be obtained after development, and the long exposure time is of no practical use. Thus, it is advisable to adjust the capacitance of the capacitor 51 which connects the developing electrode plate 45 to the conductive layer 14 of the film 10 for obtaining an image having reduced fogging, an excellent continuous tone image, and a high density image.

The curve of the developing conditions changes with the change of the shape of the electrode plate 45, the gap between the electrode plate 45 and the surface of the film 10, surface area of the electrode plate 45 facing the surface of the film, developing speed, and resistivity of the capacitor 51. The curves in FIG. 15 are obtained by using the developing means as shown in FIGS. 4, 5 and 6. If the resistance of the capacitor 51 is less than $10^9\Omega$, the developing condition curve coincides with the curve 82 being unaffected by to the capacitance of the capacitor 51. Therefore, it is necessary for obtaining good results that the capacitor have a resistance of more than $10^{10}\Omega$.

In the above described embodiment, the capacitance of the capacitor 51 which connects the electrode plate 45 to the conductive layer 14 of the film 10 can be switched according to the latent image to be developed. But it is advisable not to fix the capacitance at a constant value, but to make the value of capacitance variable in a range from 0.001 μF to 10 μF. If the capacitance of the capacitor is less than 0.001 μF, the developing condition curve coincides with the curve 80, and if the capacitance is more than 10 μF, the developing condition curve coincides with the curve 82 in FIG. 15.

What is claimed is:

1. An electrophotographic apparatus for developing an electrostatic latent image on a slide film which has a transparent film base, a conductive layer and a photosensitive layer having an electrostatic latent image thereon, and which is mounted on a slide mount, said apparatus comprising: a supporting means for supporting and holding a slide film in a processing position with said electrostatic latent image facing downwards; and developing means movable below and across a slide film held in said processing position, said developing means having a developing vessel containing a liquid developer, a developing roller partially immersed in said liquid developer for carrying a layer of the liquid developer along the peripheral surface thereof upon rotation of said roller, and developer overflow means frictionally abutting the peripheral surface of said roller for intercepting the layer of the liquid developer carried by said roller and directing said liquid developer into contact with said electrostatic latent image on the slide film in said processing position and having a developing electrode plate on the upper surface thereof facing the film held in the processing position.

2. An electrophotographic apparatus as claimed in claim 1, which further includes a capacitor electrically connected to said developing electrode plate, and means electrically connected to said capacitor for electrically connecting said capacitor to the conductive layer of said slide film.

3. An electrophotographic apparatus as claimed in claim 2, wherein the capacitance of said capacitor is no lower than 0.001 μF and is no higher than 10 μF.

4. An electrophotographic apparatus as claimed in claim 1, which further comprises a plurality of capacitors electrically connected to said developing electrode plates, means electrically connected to said capacitors for electrically connecting said capacitors to the conductive layer of said slide film, and switching means operatively associated with said capacitors for selectively connecting said developing electrode plate to the conductive layer through one of said capacitors.

5. An electrophotographic apparatus for developing an electrostatic latent image on a slide film which has a transparent film base, a conductive layer and a photosensitive layer having an electrostatic latent image thereon, and which is mounted on a slide mount, said apparatus comprising: a supporting means for supporting and holding a slide film in a processing position with said electrostatic latent image facing downwards; and developing means movable below and across a slide film held in said processing position, said developing means having a developing vessel containing a liquid developer, a developing roller partially immersed in said liquid developer for carrying a layer of the liquid developer along the peripheral surface thereof upon rotation of said roller, and developer overflow means frictionally abutting the peripheral surface of said roller for intercepting the layer of the liquid developer carried by said roller and directing said liquid developer into contact with said electrostatic latent image on the slide film in said processing position the material of said overflow means frictionally abutting said roller and the material of said roller frictionally abutting said overflow means being such that charges of a polarity opposite to the polarity of the charges of the toner in the liquid developer are produced in the surface of said overflow means, and charges of a polarity the same as the toner charges are produced on the roller surface, due to the friction between said roller and said overflow means whereby the toner particles are repelled from the roller surface and attracted toward the overflow means for causing the toner to remain in the stream of liquid developer and preventing the formation of fog on the background of the developed image.

6. An electrophotographic apparatus as claimed in claim 5, further comprising a charger, an exposure window and a drier mounted with said developing means to constitute a processing unit, said processing unit being movable below and across the slide film held in said processing position from a first position to a second position, and optical means for projecting an image of an original onto said processing position, whereby the slide film is charged and exposed to form the electrostatic latent image thereon, and then is developed and dried during the movement of said processing unit from said first position to said second position.

7. An electrophotographic apparatus as claimed in claim 6, wherein said processing unit further has therein a film kicker for engaging and discharging the slide film from said processing position during the movement of said processing unit from said second position to said first position.

8. An electrophotographic apparatus as claimed in claim 7, which further comprises a film supplying means for supplying a slide film to said processing position.

9. An electrophotographic apparatus as claimed in claim 6, which further includes a focusing plate provided at said processing position in a position for receiving a focused image from said optical means, and a finder located on the opposite side of said optical means for observing a projected image on said focusing plate when said processing position has no slide film therein.

10. An electrophotographic apparatus as claimed in claim 6, wherein the slide mount has a grounding window provided in a region around the aperture of the slide mount, and said supporting means includes a flexible conductive film means for resiliently contacting the conductive layer of the slide film through the grounding window when the slide film is in the processing position and for sliding on the surface of the slide mount during the travel of the slide film into and out of said processing position.

11. An electrophotographic apparatus for developing an electrostatic latent image on a slide film which has a transparent film base, a conductive layer and a photosensitive layer having an electrostatic latent image thereon, and which is mounted on a slide mount having an aperture therein, said apparatus comprising: a supporting means for supporting and holding a slide film in a processing position with said electrostatic latent image facing downwards; and developing means movable below and across a slide film held in said processing position, said developing means having a developing vessel containing a liquid developer, a developing roller partially immersed in said liquid developer for carrying a layer of the liquid developer along the peripheral surface thereof upon rotation of said roller, developer overflow means frictionally abutting the peripheral surface of said roller for intercepting the layer of the liquid developer carried by said roller and spouting said liquid developer to at least the height of said photosensitive layer of said slide film in said processing position only during movement of said developing means across said aperture of said slide mount so as to direct said liquid developer into contact with said electrostatic latent image on the slide film in said processing position only during movement of said developing means across said aperture of said slide mount.

* * * * *